US006561277B2

(12) United States Patent
Algeroy et al.

(10) Patent No.: US 6,561,277 B2
(45) Date of Patent: May 13, 2003

(54) FLOW CONTROL IN MULTILATERAL WELLS

(75) Inventors: John Algeroy, Missouri City, TX (US); John G. Harkness, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 20 days.

(21) Appl. No.: 09/965,480

(22) Filed: Sep. 27, 2001

(65) Prior Publication Data

US 2002/0050358 A1 May 2, 2002

Related U.S. Application Data

(60) Provisional application No. 60/298,781, filed on Jun. 15, 2001, and provisional application No. 60/240,474, filed on Oct. 13, 2000.

(51) Int. Cl.[7] ..... E21B 43/14
(52) U.S. Cl. ..... 166/373; 166/50; 166/66.6
(58) Field of Search ..... 166/50, 117.6, 166/373, 313, 53, 54, 66.6, 191, 192

(56) References Cited

U.S. PATENT DOCUMENTS

| | | | | |
|---|---|---|---|---|
| 5,337,808 A | | 8/1994 | Graham | 166/191 |
| 5,454,430 A | | 10/1995 | Kennedy et al. | 166/50 |
| 5,531,270 A | * | 7/1996 | Fletcher et al. | 166/53 |
| 5,715,891 A | | 2/1998 | Graham | 166/313 |
| 5,823,263 A | * | 10/1998 | Morris et al. | 166/313 |
| 5,845,707 A | | 12/1998 | Longbottom | 166/50 |
| 5,845,710 A | | 12/1998 | Longbottom et al. | 166/313 |
| 5,868,210 A | * | 2/1999 | Johnson et al. | 175/40 |
| 5,884,704 A | | 3/1999 | Longbottom et al. | 166/313 |
| 5,915,474 A | | 6/1999 | Buytaert et al. | 166/50 |
| 5,941,308 A | | 8/1999 | Malone et al. | 166/313 |
| 5,944,109 A | | 8/1999 | Longbottom | 166/313 |
| 5,959,547 A | | 9/1999 | Tubel et al. | 340/853.2 |
| 5,960,874 A | | 10/1999 | Morris et al. | 166/50 |
| 5,971,074 A | | 10/1999 | Longbottom et al. | 166/313 |
| 5,992,524 A | | 11/1999 | Graham | 166/313 |
| 6,003,601 A | | 12/1999 | Longbottom | 166/313 |
| 6,046,685 A | | 4/2000 | Tubel | 340/853.2 |
| 6,079,493 A | | 6/2000 | Longbotton et al. | 166/313 |
| 6,079,494 A | | 6/2000 | Longbotton et al. | 166/313 |
| 6,125,937 A | | 10/2000 | Longbottom et al. | 166/313 |
| 6,279,658 B1 | * | 8/2001 | Donovan et al. | 166/313 |

FOREIGN PATENT DOCUMENTS

| | | | |
|---|---|---|---|
| WO | WO 01/31167 | 5/2001 | E21B/43/14 |

OTHER PUBLICATIONS

Moritis, Guntis, "Smart, intelligent wells", *Oil and Gas Journal*, Apr. 2, 2001, p. 72–79.
Rhodes, Ann K., "Intelligent completions advances poised to catapult production technology forward," *Oil and Gas Journal*, Dec. 6, 1999 (reprint).

* cited by examiner

*Primary Examiner*—Frank Tsay
(74) *Attorney, Agent, or Firm*—Jeffrey E. Griffin; Brigitte L. Jeffery; John J. Ryberg

(57) ABSTRACT

This invention relates to the flow control of wellbores including a parent well and at least two lateral branches, each of which may have any direction (from vertical to horizontal). The flow from each lateral branch is independently controlled by a separate flow control device. The flow control devices are located within the parent well to enable an easier and efficient workover and intervention of such devices. In some embodiments, the flow control devices are located above the intersection between the parent well and the at least two lateral branches for similar reasons.

41 Claims, 5 Drawing Sheets

FLOW CONTROL IN MULTILATERAL WELLS

This application claims priority to U.S. Provisional Application Serial No. 60/240,474 filed on Oct. 13, 2000 by Algeroy and Harkness and to U.S. Provisional Application Serial No. 60/298,781 filed on Jun. 15, 2001 by the same inventors.

BACKGROUND

This invention relates generally to lateral and multilateral wells. Specifically, this invention relates to flow control from lateral and multilateral wells.

Multilateral wells normally include a parent well and at least two lateral branches. Each lateral branch typically intersects and drains at least one hydrocarbon formation. Formation fluid from each lateral branch flows through the relevant lateral branch and is typically commingled in the parent well with fluid from the other lateral branches.

Operators desire to have the ability to control and regulate the flow of formation fluids from each lateral branch. In order to do so, flow control devices must be included and arranged in the production string so that flow from each lateral branch can be independently controlled.

U.S. Pat. No. 6,079,494 issued to Longbottom et al. on Jun. 27, 2000 teaches one way in which to independently control the flow from lateral branches. This patent discloses a wellbore having a first and second lateral branch and one parent well. A tubing string is disposed within each lateral branch, and a Y-block connects the two lateral tubing strings to a parent tubing string that provides fluid communication to the surface of the well. A first of the lateral tubing strings includes a flow regulating device (such as a sliding sleeve). A plug is included in the second of the lateral tubing strings, and a ported tubing portion is disposed underneath the plug. A second flow regulating device (such as a sliding sleeve) is included above the Y-block and within the parent tubing string. The first flow regulating device selectively controls/regulates flow from the first formation and into the first lateral branch. Once within the first lateral branch, fluid from the first formation flows upstream, through the Y-block, and into the parent tubing string. Flow from the second formation flows into the second lateral tubing string through an opening at the lower end of the second lateral tubing string. Fluid from the second formation then flows within the second lateral tubing string and into the annulus of the wellbore through the ported tubing. The second flow regulating device then selectively controls/regulates flow of the second formation fluid that is found in the annulus from the annulus region and into the parent tubing string. Once within the parent tubing string, second formation fluid commingles with first formation fluid. Thus, first and second flow regulating device independently and selectively regulate flow from the first and second formation.

It is highly desirable, however, to have the ability to intervene into the wellbore and workover the flow control devices. Since the first flow regulating device of U.S. Pat. No. 6,079,494 is located within one of the lateral branches, it becomes difficult (if not impossible) and inefficient to access the first flow regulating device.

The prior art would therefore benefit from well constructions that include at least a first and a second flow control device to independently regulate the flow from at least a first and a second lateral branch (each having any direction), wherein both the first and second flow control devices are located in the parent well thereby facilitating the intervention and workover of such devices.

SUMMARY OF THE INVENTION

This invention relates to the flow control of wellbores including a parent well and at least two lateral branches, each of which may have any direction (from vertical to horizontal). The flow from each lateral branch is independently controlled by a separate flow control device. The flow control devices are located within the parent well to enable an easier and efficient workover and intervention of such devices. In some embodiments, the flow control devices are located above the intersection between the parent well and the at least two lateral branches for similar reasons.

DETAILED DESCRIPTION

Figure 1:
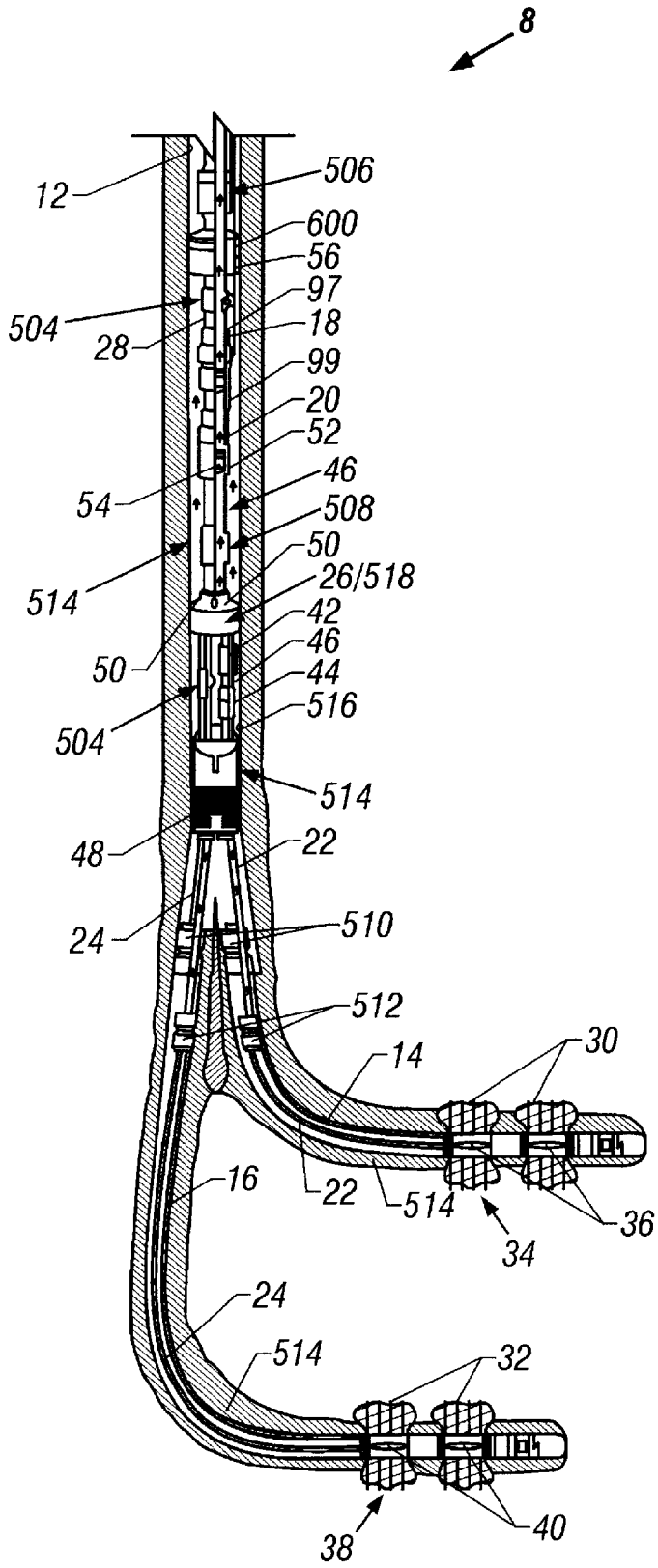
FIG. 1 is a schematic of one architecture of this invention.
Figure 2:
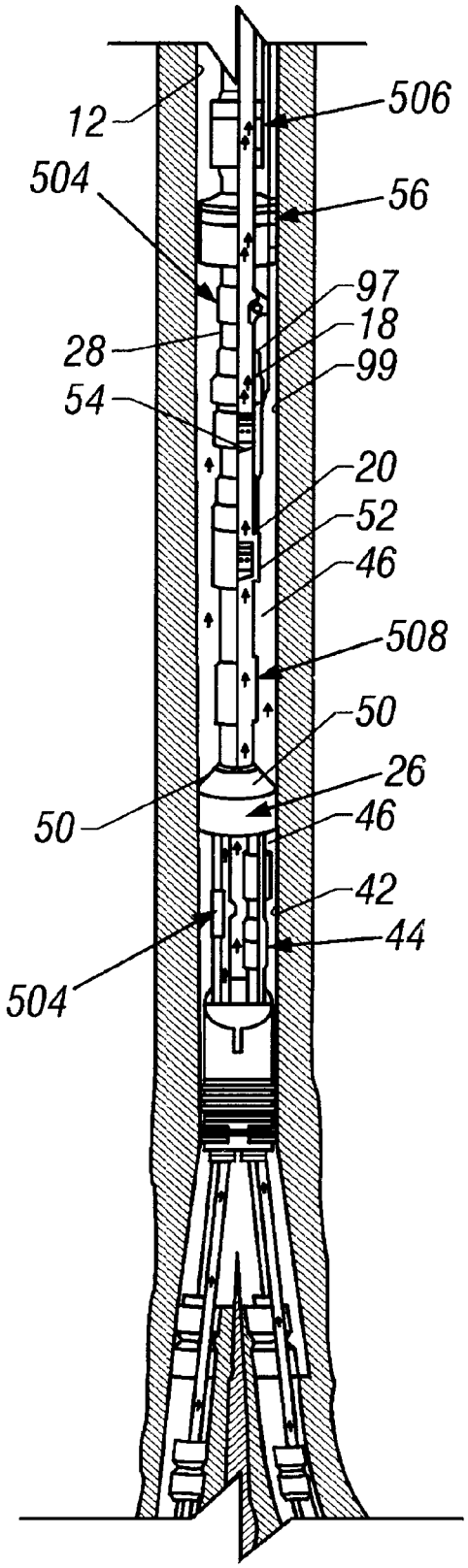
FIG. 2 is a more detailed view of the parent well of FIG. 1.

FIGS. 1 and 2 illustrate one well architecture of our invention. Our invention is disposed within a wellbore 8 that includes a parent well 12, a first lateral branch 14, and a second lateral branch 16, the first and second lateral branches 14 and 16 intersecting the parent well 12. A first conduit 22 (for example, a liner and/or a tubing string) is disposed at least partially within the first lateral branch 14, and a second conduit 24 (for example, a liner and/or a tubing string) is disposed at least partially within the second lateral branch 16. A junction 26 connects the first and second conduits 24 and 26 to a parent tubing string 28, which communicates with the surface.

First lateral branch 14 intersects a first formation 30, and second lateral branch 16 intersects a second formation 32. First and second formations 30 and 32 may or may not be part of the same reservoir. Fluid communication between the first formation 30 and the interior of the first conduit 22 is established by at least one opening 34 through first conduit 22. Openings 34 may comprise sand screens 36 as shown in the figures, or other types of flow communication devices, such as sliding sleeves, or ported tubing. Fluid communication between the second formation 32 and the interior of the second conduit 24 is established by at least one opening 38 through second conduit 24. Openings 38 may comprise sand screens 40 as shown in the figures, or other types of flow communication devices, such as sliding sleeves, or ported tubing.

A plug 42 is located within first conduit 22 underneath junction 26. Plug 42 prevents fluid flow through first conduit 22 and is, in one embodiment, located in the parent well 12. At least one opening 44 is also located on first conduit 22 underneath plug 42. At least one opening 44 provides fluid communication between the interior of the first conduit 22 and the annulus 46 region located exterior to first and second conduits 22 and 24. The at least one opening 44 may comprise a sliding sleeve that selectively provides fluid communication between the interior of the first conduit 22 and the annulus 46 region located exterior to first and second conduits 22 and 24. In one embodiment, sliding sleeve is controlled from the surface such as by control lines (hydraulic, electric, or fiber optic). A first sealing device 48, such as a packer, located underneath the at least one opening 44, sealingly isolates the region above the sealing device 48 from the region below the sealing device 48 (including the lateral branches, 14 and 16). Instead of a sliding sleeve, the at least one opening 44 may also comprise ported tubing or any other device which provides fluid communication between the interior of the first conduit 22 and the annulus 46 region located exterior to first and second conduits 22 and 24.

Junction 26 may include passageways 50 therethrough to allow fluid communication between its underside and upperside. Parent tubing string 28 includes a first flow control device 18 and a second flow control device 20. First flow control device 18 may be located above second flow control device 20. As shown in the Figures, first and second flow control devices 18, 20 may be located above the intersection between the parent well 12 and the lateral branches 14, 16.

First flow control device 18 selectively provides fluid communication between the annulus 46 and the interior of the parent tubing string 28. When first flow control device 18 is closed, fluid flow is prevented between the annulus 46 and the interior of the parent tubing string 28. When first flow control device 18 is open, fluid communication is established between the annulus 46 and the interior of the parent tubing string 28. First flow control device 18 may comprise a sliding sleeve valve which may be a variable choke valve that selectively provides different rates of flow therethrough. First flow control device 18 may be controlled from the surface by way of control line 97, which may be an electric, hydraulic, or fiber optic control line.

Second flow control device 20 selectively provides fluid communication through parent tubing string 28. When second flow control device 20 is closed, fluid flow is prevented within the parent tubing string 28 across the second flow control device 20. When second flow control device 20 is open, fluid communication is established through the parent tubing string 28 across the second flow control device 20. Second flow control device 20 may comprise a sliding sleeve valve that includes a shroud 52 and a blocking device 54, the shroud 52 and blocking device 54 routing fluid from thereunder around the sleeve valve so that the sleeve valve can provide selective flow control of such fluid. The sliding sleeve may also be a variable choke valve that selectively provides different rates of flow therethrough. Second flow control device 20 may be controlled from the surface by way of control line 99, which may be an electric, hydraulic, or fiber optic control line.

A second sealing device 56, such as packer, is located on parent tubing string 28 above first and second flow control devices 18 and 20. Together, first and second sealing devices 48 and 56 isolate the annulus 46 region located therebetween from the remainder of the parent well 12, the first lateral branch 14, and the second lateral branch 16. Second sealing device 56 includes ports 600 to allow the control lines 100 and 102 to pass therethrough.

When the operator desires to drain only the first formation 30, the first flow control device 18 is opened, and the second flow control device 20 is closed. Thus, formation fluid from the second formation 32 flows though openings 38, into and through second conduit 24, through junction 26, into parent tubing string 28, and up to closed second flow control device 20 which prevents further flow upwards. Formation fluid from the first formation 30 flows through openings 34, into first conduit 22, into annulus 46 through the at least one opening 44, and into parent tubing string 28 through open first flow control device 18.

When the operator desires to drain only the second formation 32, the first flow control device 18 is closed, and the second flow control device 20 is opened. Thus, formation fluid from the first formation 30 flows through openings 34, into first conduit 22, into annulus 46 through the at least one opening 44, and up to closed first flow control device 18 which prevents flow into parent tubing string 28. Formation fluid from the second formation 32 flows though openings 38, into and through second conduit 24, through junction 26, into parent tubing string 28, within shroud 53, through open second flow control device 20, and continues within parent tubing string 28.

When the operator desires to drain both the first and second formations 30 and 32, the first and second flow control devices 18 and 20 are both opened. Fluid flow from each formation progresses as detailed above until the fluid from the first formation 30 reaches the first flow control device 18. As the first formation fluid passes through open first flow control device 18, it becomes commingled with the second formation fluid that is flowing through parent tubing string 28. Thus, commingled flow from the first and second formations 30 and 32 continues within the parent tubing string 28 to the surface of the wellbore 8.

When the operator desires to not flow from either first or second formation 30 and 32, both the first and second flow control devices 18 and 20 are closed. Thus, fluid from the first formation 30 is restricted within the annulus 46 by first flow control device 18, and fluid from the second formation 32 is restricted by second flow control device 20 within parent tubing string 28 (underneath second flow control device 20).

By selectively opening and/or closing the first and/or second flow control devices 18 and 20, the operator can independently control the flow from first and second formations 30 and 32. By selectively choking first or second flow control devices 18 and 20, the operator can selectively control the rate of flow from first and second formations 30 and 32.

Since both first and second flow control devices 18 and 20 are located above the junction 26 (above the intersection between the parent well 12 and the lateral branches 14, 16 and not within the lateral branches), an operator may more easily intervene and workover the devices 18 and 20. The devices 18 and 20 may thus be replaced, fixed, etc. without having to access either lateral branch 14 or 16.

Figure 4:
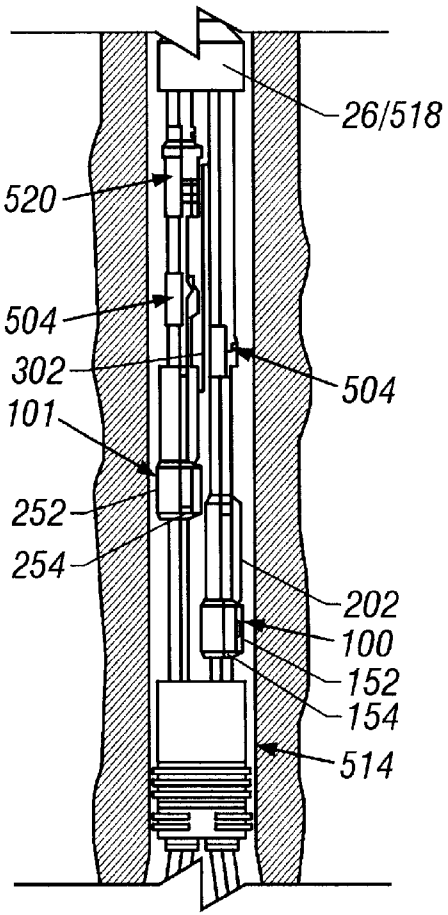
FIG. 4 is a more detailed view of the parent well of FIG. 3.
Figure 3:
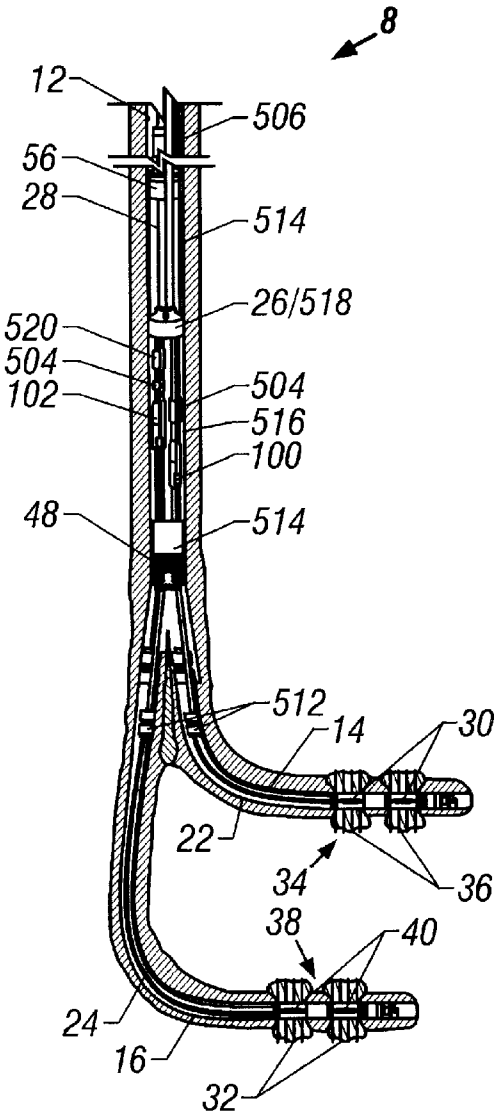
FIG. 3 is a schematic of a second architecture of this invention.

FIGS. 3 and 4 illustrate a second well architecture of our invention. This well architecture is somewhat similar to that of FIGS. 1 and 2, and corresponding reference numbers will therefore remain the same. Wellbore 8 also includes a parent well 12, a first lateral branch 14, and a second lateral branch 16, the first and second lateral branches 14 and 16 intersecting the parent well 12. A first conduit 22 (for example, a liner and/or a tubing string) is disposed at least partially within the first lateral branch 14, and a second conduit 24 (for example, a liner and/or a tubing string) is disposed at least partially within the second lateral branch 16. A junction 26 connects the first and second conduits 24 and 26 to a parent tubing string 28, which communicates with the surface.

First lateral branch 14 intersects a first formation 30, and second lateral branch 16 intersects a second formation 32.

First and second formations 30 and 32 may or may not be part of the same reservoir. Fluid communication between the first formation 30 and the interior of the first conduit 22 is established by at least one opening 34 through first conduit 22. Openings 34 may comprise sand screens 36 as shown in the figures, or other types of flow communication devices, such as sliding sleeves, or ported tubing. Fluid communication between the second formation 32 and the interior of the second conduit 24 is established by at least one opening 38 through second conduit 24. Openings 38 may comprise sand screens 40 as shown in the figures, or other types of flow communication devices, such as sliding sleeves, or ported tubing.

First conduit 22 includes a first flow control device 100. Second conduit 24 includes a second flow control device 101. Both the first flow control device 100 and the second flow control device 101 may be located above the intersection of the first and second lateral branches 14 and 16 and the parent well 12. Both the first flow control device 100 and the second flow control device 101 are located below the junction 26.

First flow control device 100 selectively provides fluid communication through first conduit 22. When first flow control device 100 is closed, fluid flow is prevented within the first conduit 22 across the first flow control device 100. When first flow control device 100 is open, fluid communication is established through the first conduit 22 across the first flow control device 100. First flow control device 100 may comprise a sliding sleeve valve that includes a shroud 152 and a blocking device 154, the shroud 152 and blocking device 154 routing fluid from thereunder around the sleeve valve so that the sleeve valve can provide selective flow control of such fluid. The sliding sleeve may also be a variable choke valve that selectively provides different rates of flow therethrough. First flow control device 100 may be controlled from the surface by way of control line 202, which may be an electric, hydraulic, or fiber optic control line.

Second flow control device 101 selectively provides fluid communication through second conduit 24. When second flow control device 101 is closed, fluid flow is prevented within the second conduit 24 across the second flow control device 101. When second flow control device 101 is open, fluid communication is established through the second conduit 24 across the second flow control device 101. Second flow control device 101 may comprise a sliding sleeve valve that includes a shroud 252 and a blocking device 254, the shroud 252 and blocking device 254 routing fluid from thereunder around the sleeve valve so that the sleeve valve can provide selective flow control of such fluid. The sliding sleeve may also be a variable choke valve that selectively provides different rates of flow therethrough. Second flow control device 101 may be controlled from the surface by way of control line 302, which may be an electric, hydraulic, or fiber optic control line.

Sealing devices 48 and 56 (such as packers) may be located above and below the first and second flow control devices 100 and 101. Sealing devices 48 and 56 thus isolate the annulus region located therebetween from the remainder of the parent well, first lateral branch, and second lateral branch.

When the operator desires to drain only the first formation 30, the first flow control device 100 is opened, and the second flow control device 101 is closed. Thus, formation fluid from the second formation 32 flows though openings 38, into and through second conduit 24, and up to closed second flow control device 101 which prevents further flow upwards. Formation fluid from the first formation 30 flows through openings 34, into first conduit 22, within shroud 152, through open first flow control device 100, through junction 26, and into parent tubing string 28.

When the operator desires to drain only the second formation 32, the second flow control device 101 is opened, and the first flow control device 100 is closed. Thus, formation fluid from the first formation 30 flows though openings 34, into and through first conduit 22, and up to closed first flow control device 100 which prevents further flow upwards. Formation fluid from the second formation 32 flows through openings 38, into second conduit 24, within shroud 252, through open second flow control device 101, through junction 26, and into parent tubing string 28.

When the operator desires to drain both the first and second formations 30 and 32, the first and second flow control devices 100 and 101 are both opened. Fluid flow from each formation progresses as detailed above until the fluid from both formations reach the junction 26, at which point the flows become comingled. Thus, commingled flow from the first and second formations 30 and 32 continues within the parent tubing string 28 to the surface of the wellbore 8.

When the operator desires to not flow from either first or second formation 30 and 32, both the first and second flow control devices 100 and 101 are closed. Thus, fluid from the first formation 30 is restricted by first flow control device 100 within first conduit 22, and fluid from the second formation 32 is restricted by second flow control device 101 within second conduit 24.

By selectively opening and/or closing the first and/or second flow control devices 100 and 101, the operator can independently control the flow from first and second formations 30 and 32. By selectively choking first or second flow control devices 100 and 101, the operator can selectively control the rate of flow from first and second formations 30 and 32.

Since both first and second flow control devices 100 and 101 are located above the intersection between the parent well 12 and lateral branches 14, 16 (and not within the lateral branches), an operator may more easily intervene and workover the devices 100 and 101. The devices 100 and 101 may thus be replaced, fixed, etc. without having to access either lateral branch 14 or 16.

Figure 6:
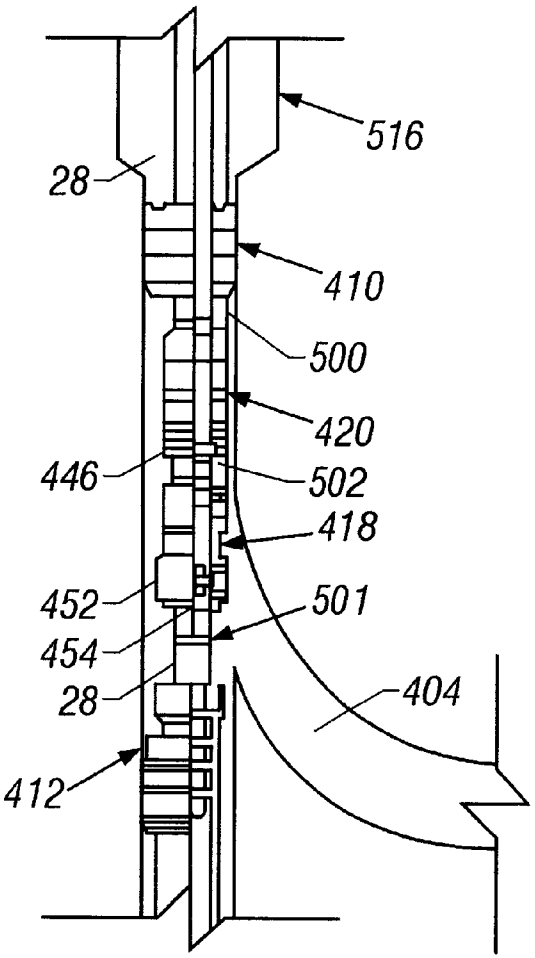
FIG. 6 is a more detailed view of the parent well of FIG. 5.
Figure 5:
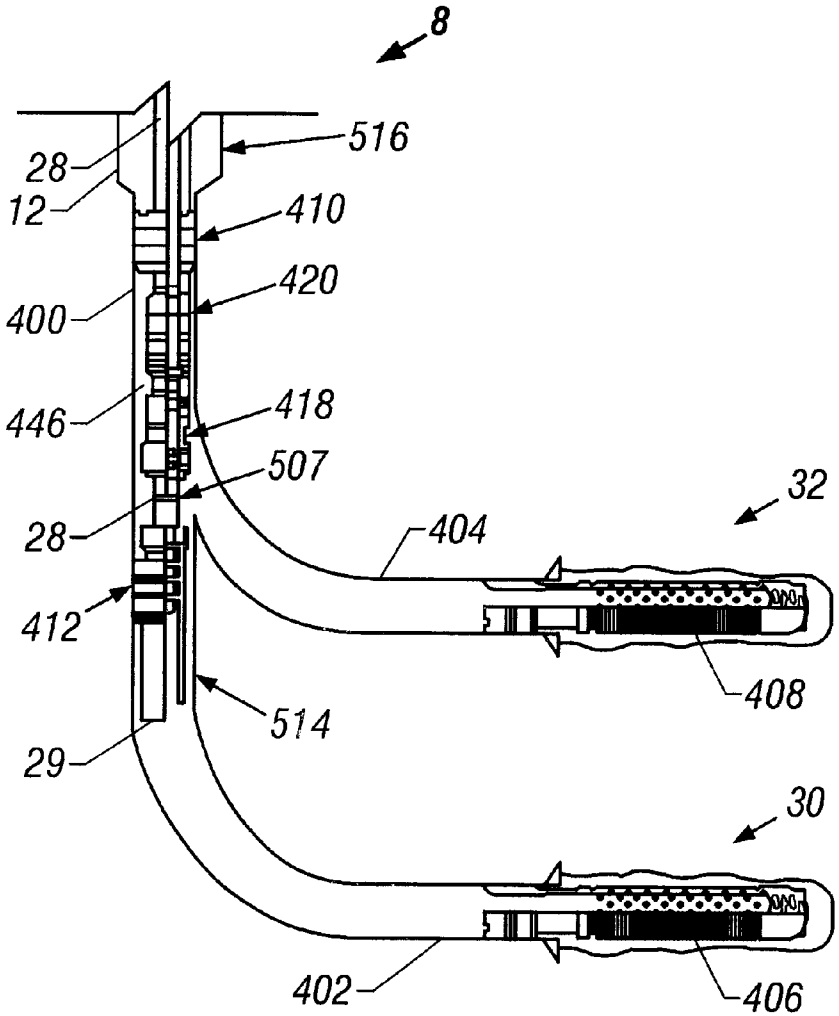
FIG. 5 is a schematic of a third architecture of this invention.

FIGS. 5 and 6 show a third architecture. A wellbore 8 includes a parent well 12 that may include a vertical section 400 and a horizontal (or inclined) section 402. The wellbore 8 further includes a lateral branch 404 that intersects the parent well 12. Parent well 12 intersects a first formation 30 preferably beneath the intersection of the lateral branch 404 and the parent well 12. Lateral branch 404 intersects a second formation 32. Formation fluids from the first formation 30 flow into the parent well 12, and may do so through a sand screen 406 installed within the parent well 12. Formation fluids from the second formation 33 flow into the lateral branch 404, and may do so through a sand screen 408 installed within the lateral branch 404.

A first sealing device 410, such as a packer, is installed below the intersection between the parent well 12 and the lateral branch 404. A second sealing device 412, such as a packer, is installed above the intersection between the parent well and the lateral branch 404. Together, first and second sealing devices 410 and 412 isolate the annulus 446 region located therebetween from the remainder of the parent well 12. A parent tubing string 28 extends within the parent well 12 at least from the first sealing device 410 upwards. The bottom end 29 of the parent tubing string 28 is in fluid communication with the first formation 30.

Parent tubing string 28 includes a first flow control device 418 and a second flow control device 420. First flow control device 418 may be located below second flow control device 420. As shown in the Figures, first and second flow control devices 418, 420 may be located between the first and second sealing devices 410, 412.

First flow control device 418 selectively provides fluid communication through parent tubing string 28. When first flow control device 418 is closed, fluid flow is prevented within the parent tubing string 28 across the first flow control device 418. When first flow control device 418 is open, fluid communication is established through the parent tubing string 28 across the first flow control device 418. First flow control device 418 may comprise a sliding sleeve valve that includes a shroud 452 and a blocking device 454, the shroud 452 and blocking device 454 routing fluid from thereunder around the sleeve valve so that the sleeve valve can provide selective flow control of such fluid. The sliding sleeve may also be a variable choke valve that selectively provides different rates of flow therethrough. First flow control device 418 may be controlled from the surface by way of control line 502, which may be an electric, hydraulic, or fiber optic control line.

Second flow control device 420 selectively provides fluid communication between the annulus 446, which is in fluid communication with the lateral branch 404, and the interior of the parent tubing string 28. When second flow control device 420 is closed, fluid flow is prevented between the annulus 446 (lateral branch 404) and the interior of the parent tubing string 28. When second flow control device 420 is open, fluid communication is established between the annulus 446 (lateral branch 404) and the interior of the parent tubing string 28. Second flow control device 420 may comprise a sliding sleeve valve which may be a variable choke valve that selectively provides different rates of flow therethrough. Second flow control device 420 may be controlled from the surface by way of control line 500, which may be an electric, hydraulic, or fiber optic control line.

When the operator desires to drain only the first formation 30, the first flow control device 418 is opened, and the second flow control device 420 is closed. Thus, formation fluid from the second formation 32 flows though sand screen 408, into lateral branch 404, into annulus 446, and up to closed second flow control device 420 which prevents flow into parent tubing string 28. Formation fluid from the first formation 30 flows through sand screen 406, into parent tubing string 28, within shroud 452, through open first flow control device 420, and continues within parent tubing string 28.

When the operator desires to drain only the second formation 32, the first flow control device 418 is closed, and the second flow control device 420 is opened. Thus, formation fluid from the first formation 30 flows through sand screen 406, into parent tubing string 28, and up to closed first flow control device 418 which prevents further flow through parent tubing string 28. Formation fluid from the second formation 32 flows though sand screen 408, into lateral branch 404, into annulus 446, through open second flow control device 420, and continues within parent tubing string 28.

When the operator desires to drain both the first and second formations 30 and 32, the first and second flow control devices 418 and 420 are both opened. Fluid flow from each formation progresses as detailed above until the fluid from the second formation 32 reaches the second flow control device 420. As the second formation fluid passes through open second flow control device 420, it becomes commingled with the first formation fluid that is flowing through parent tubing string 28. Thus, commingled flow from the first and second formations 30 and 32 continues within the parent tubing string 28 to the surface of the wellbore 8.

When the operator desires to not flow from either first or second formation 30 and 32, both the first and second flow control devices 418 and 420 are closed. Thus, fluid from the second formation 32 is restricted within the annulus 446 by second flow control device 420, and fluid from the first formation 30 is restricted by first flow control device 418 within parent tubing string 28 (underneath second flow control device 420).

By selectively opening and/or closing the first and/or second flow control devices 418 and 420, the operator can independently control the flow from first and second formations 30 and 32. By selectively choking first or second flow control devices 418 and 420, the operator can selectively control the rate of flow from first and second formations 30 and 32.

Since both first and second flow control devices 418 and 420 are located within parent well 12 (and not within the lateral branches), an operator may more easily intervene and workover the devices 418 and 420. The devices 418 and 420 may thus be replaced, fixed, etc.

In each of these architectures, the completion may include various other devices, such as fluid characteristic monitoring devices 504 (pressure, temperature, and/or flow rate—such as the FloWatcher monitoring device shown in the Figure), subsurface safety valve devices 506, other sealing devices 507 (such as other packers and polished bore receptacle and seal bore connections), expansion joints 508, liners 510, liner hangers 512, casing 514, multilateral casing junctions 516 (such as disclosed in U.S. Pat. No. 5,944,107, which provides mechanical and sealing integrity to the intersection of the parent and lateral wells), intervention discriminators 518 (which allow selective intervention in downhole conduits), and pressure relief valves 520. Some of these devices are shown in the Figures. For instance, as shown in the Figures, the parent well 12 may be cased with casing 514 and the lateral branches, 14 and 16, may be lined with liners 510 secured in place by liner hangers 512.

Figure 7:
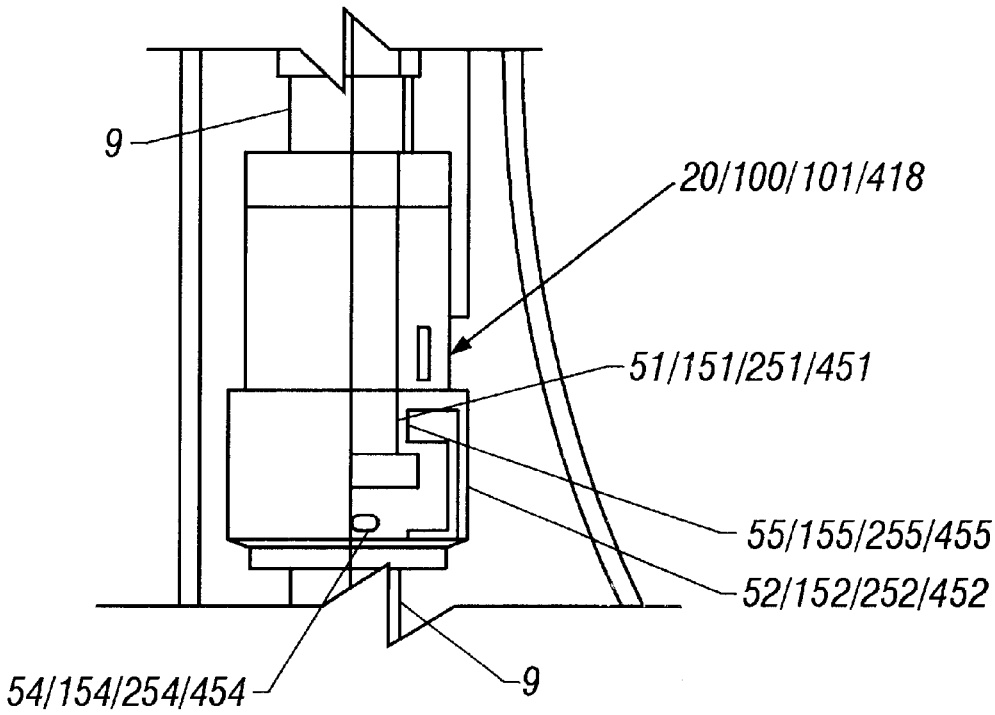
FIG. 7 is a detailed view of one flow control device discussed in this invention.

FIG. 7 shows a more detailed view of one type of flow control device discussed herein, that is a flow control device that includes a sleeve valve, a shroud, and a plug, and which controls fluid flow through/along its connected tubing string. These devices are referred to as "in-line" valves or flow control devices. The device shown in FIG. 7 may be used as flow control device 20, 100, 101, and 418. A plug 54/154/254/454 blocks fluid from continuing its upward travel through a tubing string 9 and diverts it into shroud 52/152/252/452. Shroud 52/152/252/452 surrounds a sleeve valve 51/151/252/451, which sleeve is shown in its closed position in FIG. 7 (but open in FIG. 2 for example). When the sleeve is in the closed position, further fluid flow is prevented by the closed sleeve. When the sleeve is in the open position, fluid flows out of the shroud 52/152/252/452, through ports 55/155/255/455, and continues upward through tubing string 9. As previously disclosed, the sleeve valve may also be an adjustable choke providing variable flow rate through the ports and valve.

It should be noted that although the Figures show lateral branches 14 and 16 (as well as 404 and 402) having a generally horizontal direction, such lateral branches may also have any direction (from vertical to horizontal), including the same direction as the parent well 12, and still fall within the scope of this invention.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A multilateral production system comprising:

a parent well having tubing;

a first and a second lateral branch;

the first and second lateral branches intersecting the parent well;

a first flow control device adapted to regulate fluid flow from the first lateral branch;

a second flow control device adapted to regulate fluid flow from the second lateral branch; and the first and second flow control devices being located above the intersection between the parent well and the first and second lateral branches.

2. The system of claim 1, wherein at least one of the first and second flow control devices is remotely controllable.

3. The system of claim 1, wherein both the first and second flow control devices are remotely controllable.

4. The system of claim 1, wherein:

the fluid flow from the first lateral branch is in fluid communication with an annulus of the parent well; and the first flow control device regulates the fluid flow from the annulus into the tubing.

5. The system of claim 4, wherein the first flow control device is a sleeve valve.

6. The system of claim 4, further comprising:

a first conduit disposed at least partially within the first lateral branch and connected to the tubing;

the first conduit adapted to receive fluid from the first lateral branch;

a second conduit disposed at least partially within the second lateral branch and in fluid communication with the tubing;

the second conduit adapted to receive fluid from the second lateral branch;

the first and second flow control devices disposed on the tubing; and the tubing disposed at least partially within the parent well.

7. The system of claim 6, further comprising a junction for providing fluid communication between the first and second conduits and the production tubing.

8. The system of claim 6, wherein the first conduit includes at least one opening providing fluid communication between the interior of the first conduit and the annulus of the parent well.

9. The system of claim 8, wherein:

a plug is disposed in the first conduit above the at least one opening; and the plug prevents fluid communication between the first conduit and the tubing.

10. The system of claim 9, further comprising:

a first sealing device disposed around the first and second conduits;

the first sealing device adapted to sealingly engage the parent well; and the first sealing device located below the at least one opening of the first conduit.

11. The system of claim 10, further comprising:

a second sealing device disposed around the tubing;

the second sealing device adapted to sealingly engage the parent well;

the second sealing device located above the at least one opening of the first conduit;

wherein the first and second sealing devices isolate the portion of the annulus of the parent well located therebetween.

12. The system of claim 11, wherein the first and second flow control devices are located intermediate the first and second sealing devices.

13. The system of claim 8, wherein:

when the first flow control device is open, fluid from the first lateral branch flows from the first lateral branch, into the first conduit, into the annulus of the parent well through the at least one opening of the first conduit, and into the tubing through the open flow control device; and when the first flow control device is closed, fluid from the first lateral branch flows from the first lateral branch, into the first conduit, into the annulus of the parent well through the at least one opening of the first conduit, and is not permitted to enter into the tubing due to the closed state of the flow control device.

14. The system of claim 4, wherein the second flow control device regulates fluid flow from the second conduit through the tubing.

15. The system of claim 14, wherein the second flow control device is an in-line sleeve valve.

16. The system of claim 14, wherein:

when the second flow control device is open, fluid from the second lateral branch flows from the second lateral branch, into and through the second conduit, into the tubing, through the open flow control device, and through the remainder of the tubing; and when the second flow control device is closed, fluid from the second lateral branch flows from the second lateral branch, into and through the second conduit, into the tubing, and is not permitted to continue through the remainder of the tubing due to the closed state of the flow control device.

17. The system of claim 14, wherein the first flow control device is located above the second flow control device.

18. The system of claim 4, wherein fluid flow from the first lateral branch commingles with fluid flow from the second lateral branch at the first flow control device when both the first and second flow control devices are open.

19. The system of claim 1, further comprising:

a first conduit disposed at least partially within the first lateral branch and in fluid communication with the tubing;

the first conduit adapted to receive fluid from the first lateral branch;

a second conduit disposed at least partially within the second lateral branch and in fluid communication with the tubing;

the second conduit adapted to receive fluid from the second lateral branch;

the first flow control device disposed on the first conduit;

the second flow control device disposed on the second conduit; and the tubing disposed at least partially within the parent well.

20. The system of claim 19, further comprising a junction for providing fluid communication between the first and second conduits and the production tubing.

21. The system of claim 19, wherein the first flow control device regulates fluid flow from the first conduit through the tubing.

22. The system of claim 21, wherein the first flow control device is an in-line sleeve valve.

23. The system of claim 21, wherein:

when the first flow control device is open, fluid from the first lateral branch flows from the first lateral branch, into the first conduit, along the first conduit, through the open flow control device, and into and through the tubing; and when the first flow control device is closed, fluid from the first lateral branch flows from the first lateral branch, into the first conduit, along the first conduit, and is not permitted to continue through the remainder of the first conduit and the tubing due to the closed state of the flow control device.

24. The system of claim 21, wherein the second flow control device regulates fluid flow from the second conduit through the tubing.

25. The system of claim 24, wherein the second flow control device is an in-line sleeve valve.

26. The system of claim 24, wherein:

when the second flow control device is open, fluid from the second lateral branch flows from the second lateral branch, into the second conduit, along the second conduit, through the open flow control device, and into and through the tubing; and when the second flow control device is closed, fluid from the second lateral branch flows from the second lateral branch, into the second conduit, along the second conduit, and is not permitted to continue through the remainder of the second conduit and the tubing due to the closed state of the flow control device.

27. The system of claim 19, wherein fluid flow from the first lateral branch commingles with fluid flow from the second lateral branch at the tubing when both first and second control flow control devices are open.

28. A method of controlling flow in a multilateral well, the multilateral well including a parent well and a first and second lateral branch, the first and second lateral branches intersecting the parent well, the method comprising:

receiving fluid flow from the first and second lateral branches;

providing a first flow control device in communication with the fluid flow of the first lateral branch;

providing a second flow control device in communication with the fluid flow of the second lateral branch;

selectively regulating the flow of fluid through the flow control devices; and locating the first and second flow control devices above the intersection between the parent well and the first and second lateral branches.

29. The method of claim 28, wherein the selectively regulating step comprises remotely selectively regulating the flow of fluid through the flow control devices.

30. The method of claim 28, further comprising:

establishing fluid communication between the first lateral branch and an annulus of the parent well so as to allow fluid flow from the first lateral branch to pass into the annulus; and selectively regulating the fluid flow from the annulus into the tubing by operating the first flow control device.

31. The method of claim 28, further comprising:

disposing a first conduit at least partially within the first lateral branch, the first conduit being in fluid communication with the tubing and adapted to receive fluid from the first lateral branch;

disposing a second conduit at least partially within the second lateral branch, the second conduit being in fluid communication with the tubing and adapted to receive fluid from the second lateral branch;

locating the first flow control device on the first conduit;

locating the second flow control device on the second conduit; and disposing the tubing at least partially within the parent well.

32. A system for completing a multilateral well in the earth, comprising:

a tubing and a first and second conduit;

a junction interconnecting the tubing and the first and second conduits;

a first flow control device regulating external fluid flow between the tubing and the first conduit;

a second flow control device regulating fluid flow between the tubing and the second conduit; and the first and second flow control devices located above the junction.

33. The system of claim 32, wherein the first conduit includes at least one opening providing fluid communication between the interior and exterior of the first conduit.

34. The system of claim 33, wherein:

a plug is disposed in the first conduit above the at least one opening; and the plug prevents fluid communication between the first conduit and the tubing.

35. The system of claim 32, wherein:

the tubing extends from a parent well to the earth's surface;

the first conduit extends partially within the first lateral branch and is adapted to receive fluid flow from the first lateral branch; and the second conduit extends partially within the second lateral branch and is adapted to receive fluid flow from the second lateral branch.

36. A system for completing a multilateral well, comprising:

a tubing and a first and second conduit;

a junction interconnecting the tubing and the first and second conduits;

a first flow control device regulating external fluid flow between the tubing and the first conduit;

a second flow control device regulating fluid flow between the tubing and the second conduit; and the first and second flow control devices located on the tubing.

37. The system of claim 36, wherein the first conduit includes at least one opening providing fluid communication between the interior and exterior of the first conduit.

38. The system of claim 37, wherein:

a plug is disposed in the first conduit above the at least one opening; and the plug prevents fluid communication between the first conduit and the tubing.

39. The system of claim 36, wherein:

the tubing extends from a parent well to the earth's surface;

the first conduit extends partially within the first lateral branch and is adapted to receive fluid flow from the first lateral branch; and the second conduit extends partially within the second lateral branch and is adapted to receive fluid flow from the second lateral branch.

40. A system for completing a multilateral well, comprising:

a tubing and a first and second conduit;

a junction interconnecting the tubing and the first and second conduits;

a first flow control device regulating fluid flow between the tubing and the first conduit;

a second flow control device regulating fluid flow between the tubing and the second conduit; and the first and second flow control devices located above the junction.

41. The system of claim 40, wherein:

the tubing extends from a parent well to the earth's surface;

the first conduit extends partially within the first lateral branch and is adapted to receive fluid flow from the first lateral branch; and the second conduit extends partially within the second lateral branch and is adapted to receive fluid flow from the second lateral branch.

* * * * *